US011236493B2

(12) United States Patent
Cheng et al.

(10) Patent No.: US 11,236,493 B2
(45) Date of Patent: Feb. 1, 2022

(54) METHOD AND APPARATUS FOR CONTROLLING EQUIPMENT

(71) Applicant: BEIJING BAIDU NETCOM SCIENCE AND TECHNOLOGY CO., LTD., Beijing (CN)

(72) Inventors: Xinjing Cheng, Beijing (CN); Ruigang Yang, Beijing (CN); Yajue Yang, Beijing (CN); Feixiang Lu, Beijing (CN); Hao Xu, Beijing (CN)

(73) Assignee: BEIJING BAIDU NETCOM SCIENCE AND TECHNOLOGY CO., LTD., Beijing (CN)

( * ) Notice: Subject to any disclaimer, the term of this patent is extended or adjusted under 35 U.S.C. 154(b) by 170 days.

(21) Appl. No.: 16/674,983

(22) Filed: Nov. 5, 2019

(65) Prior Publication Data

US 2020/0240119 A1 Jul. 30, 2020

(30) Foreign Application Priority Data

Jan. 25, 2019 (CN) ..... 201910075857.2

(51) Int. Cl.

| | |
|---|---|
| ***E02F 9/26*** | (2006.01) |
| ***E02F 3/32*** | (2006.01) |
| ***G07C 5/08*** | (2006.01) |

(52) U.S. Cl.

CPC ..... *E02F 9/265* (2013.01); *E02F 3/32* (2013.01); *G07C 5/08* (2013.01)

(58) Field of Classification Search

None

See application file for complete search history.

(56) References Cited

U.S. PATENT DOCUMENTS

| | | | | |
|---|---|---|---|---|
| 4,627,013 | A | 12/1986 | Ichiyama et al. | |
| 2016/0109270 | A1* | 4/2016 | Zabegaev | G01D 21/02 702/141 |
| 2017/0342680 | A1* | 11/2017 | Iwamura | E02F 9/262 |
| 2018/0094407 | A1* | 4/2018 | Hayes | E02F 9/2271 |

FOREIGN PATENT DOCUMENTS

| | | | |
|---|---|---|---|
| CN | 104884713 | A | 9/2015 |
| CN | 105378186 | A | 3/2016 |
| CN | 107882103 | A | 4/2018 |
| JP | 06146333 | A | 5/1994 |
| JP | 7-36014 | A | 2/1995 |
| JP | 7-138992 | A | 5/1995 |
| JP | 11-158930 | A | 6/1999 |
| JP | 2000266503 | A | 9/2000 |
| WO | 2014/192474 | A1 | 4/2014 |

* cited by examiner

*Primary Examiner* — Jonathan M Dager
*Assistant Examiner* — Garrett F Evans
(74) *Attorney, Agent, or Firm* — Seed IP Law Group LLP

(57) ABSTRACT

Embodiments of the present disclosure relate to a method and apparatus for controlling equipment. The method includes: acquiring an electrical signal collected by a displacement sensor; determining a displacement of a movable rod of a hydraulic cylinder relative to a cylinder tube of the hydraulic cylinder according to the electrical signal; determining, according to the displacement, a rotating angle of a mechanical arm connected to the movable rod relative to a mechanical arm connected to the cylinder tube; and controlling equipment according to the rotating angle.

8 Claims, 5 Drawing Sheets

METHOD AND APPARATUS FOR CONTROLLING EQUIPMENT

CROSS-REFERENCE TO RELATED APPLICATIONS

This application claims priority to Chinese Application No. 201910075857.2, filed on Jan. 25, 2019 and entitled "Method and Apparatus for Controlling Equipment," the entire disclosure of which is hereby incorporated by reference.

TECHNICAL FIELD

Embodiments of the present disclosure relate to the field of machine control technology, and specifically to a method and apparatus for controlling equipment.

BACKGROUND

With the improvement of engineering intellectualization, excavators begin to develop towards semi-automatic or full-automatic control. Since the premise of realizing the semi-automatic or full-automatic control is that an excavator may perceive its own orientation, it is necessary to measure a rotating angle of each component of the excavator in real time.

SUMMARY

Embodiments of the present disclosure disclose a method and apparatus for controlling equipment.

In a first aspect, an embodiment of the present disclosure provides a method for controlling equipment, comprising: acquiring an electrical signal collected by a displacement sensor; determining a displacement of a movable rod of a hydraulic cylinder relative to a cylinder tube of the hydraulic cylinder according to the electrical signal; determining, according to the displacement, a rotating angle of a mechanical arm connected to the movable rod relative to a mechanical arm connected to the cylinder tube; and controlling equipment according to the rotating angle.

In some embodiments, the equipment is an excavator, and the equipment comprises a plurality of hydraulic cylinders and a plurality of displacement sensors in one-to-one correspondence to the plurality of hydraulic cylinders, and further comprises a bucket connected to an excavator chassis through a plurality of mechanical arms connected to the plurality of hydraulic cylinders; and the controlling the equipment according to the rotating angle comprises: determining a position and an orientation of the bucket according to the rotating angle; and controlling the equipment according to the position and the orientation of the bucket.

In some embodiments, the electrical signal comprises an identifier; and the determining the rotating angle of the mechanical arm connected to the movable rod relative to the mechanical arm connected to the cylinder tube according to the displacement comprises: determining, according to the identifier, an angle calculation formula corresponding to the identifier; and determining the rotating angle according to the displacement and the angle calculation formula.

In some embodiments, the displacement sensor is a guyed displacement sensor.

In some embodiments, the guyed displacement sensor comprises a body and a pull wire, and one end of the pull wire is connected to the body; and the body is fixed to the cylinder tube of the hydraulic cylinder, and the other end of the pull wire is fixed to the movable rod of the hydraulic cylinder.

In a second aspect, an embodiment of the present disclosure provides an apparatus for controlling equipment, comprising: an electrical signal acquisition unit, configured for acquiring an electrical signal collected by a displacement sensor, the displacement sensor being used for measuring a displacement of a movable rod of a hydraulic cylinder relative to a cylinder tube of the hydraulic cylinder; a displacement determination unit, configured for determining the displacement of the movable rod of the hydraulic cylinder relative to the cylinder tube of the hydraulic cylinder according to the electrical signal; an angle determination unit, configured for determining, according to the displacement, a rotating angle of a mechanical arm connected to the movable rod relative to a mechanical arm connected to the cylinder tube; and an equipment control unit, configured for controlling equipment according to the rotating angle.

In some embodiments, the equipment is an excavator, and the equipment comprises a plurality of hydraulic cylinders and a plurality of displacement sensors in one-to-one correspondence to the plurality of hydraulic cylinders, and further comprises a bucket connected to an excavator chassis through a plurality of mechanical arms connected to the plurality of hydraulic cylinders; and the equipment control unit is further configured for: determining a position and an orientation of the bucket according to the rotating angle; and controlling the equipment according to the position and the orientation of the bucket.

In some embodiments, the electrical signal comprises an identifier; and the angle determination unit is further configured for: determining, according to the identifier, an angle calculation formula corresponding to the identifier; and determining the rotating angle according to the displacement and the angle calculation formula.

In some embodiments, the displacement sensor is a guyed displacement sensor.

In some embodiments, the guyed displacement sensor comprises a body and a pull wire, and one end of the pull wire is connected to the body; and the body is fixed to the cylinder tube of the hydraulic cylinder, and the other end of the pull wire is fixed to the movable rod of the hydraulic cylinder.

In a third aspect, an embodiment of the present disclosure provides an electronic device, comprising: one or more processors; and a storage apparatus, storing one or more programs, wherein the one or more programs, when executed by the one or more processors, cause the one or more processors to implement the method according to any embodiment in the first aspect.

In a fourth aspect, an embodiment of the present disclosure provides a computer readable medium, storing a computer program, wherein the program, when executed by a processor, implements the method according to any embodiment in the first aspect.

The method and apparatus for controlling equipment provided by some embodiments of the present disclosure may: first, acquire an electric signal collected by a displacement sensor, the displacement sensor being used for measuring a displacement of a movable rod of a hydraulic cylinder relative to a cylinder tube of the hydraulic cylinder; and then, determine the displacement of the movable rod of the hydraulic cylinder relative to the cylinder tube of the hydraulic cylinder according to the electrical signal; and then, determine a rotating angle of a mechanical arm connected to the movable rod relative to a mechanical arm connected to the cylinder tube according to the displacement; and finally, control equipment according to the rotating angle. The method according to the present embodiment may precisely sense a rotating angle between mechanical arms, and is thus conductive to automatically controlling the equipment.

BRIEF DESCRIPTION OF THE DRAWINGS

After reading detailed descriptions of non-limiting embodiments with reference to the following accompanying drawings, other features, objectives and advantages of the present disclosure will become more apparent.

DETAILED DESCRIPTION OF EMBODIMENTS

Embodiments of present disclosure will be described below in detail with reference to the accompanying drawings. It should be appreciated that the specific embodiments described herein are merely used for explaining the relevant disclosure, rather than limiting the disclosure. In addition, it should be noted that, for the ease of description, only the parts related to the relevant disclosure are shown in the accompanying drawings.

It should also be noted that some embodiments in the present disclosure and some features in the disclosure may be combined with each other on a non-conflict basis. Features of the present disclosure will be described below in detail with reference to the accompanying drawings and in combination with embodiments.

Figure 1:
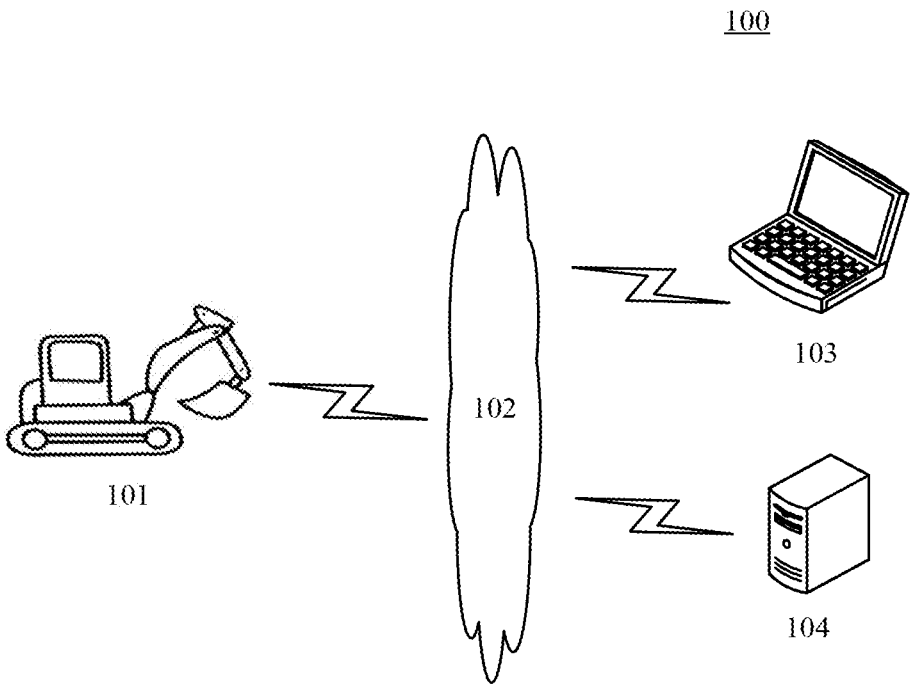
FIG. 1 is a diagram of an example system architecture in which an embodiment of the present disclosure may be implemented.

FIG. 1 shows an example system architecture 100 in which a method for controlling equipment or an apparatus for controlling equipment according to embodiments of the present disclosure may be implemented.

As shown in FIG. 1, the system architecture 100 may include an excavator 101, a network 102, a terminal device 103 and a server 10*d*. The network 102 serves as a medium providing a communication link between the excavator 101, the terminal device 103 and the server 104. The network 102 may include various types of connections, such as wired or wireless communication links, or optical fibers.

The excavator 101 may include a plurality of mechanical arms driven by hydraulic cylinders, and a displacement sensor for measuring a displacement of a movable rod of a hydraulic cylinder relative to a cylinder tube of the hydraulic cylinder. The hydraulic cylinder may include various types of hydraulic cylinders such as a piston type, a plunger type, a telescopic type and a swing type. The displacement sensor may include various types of displacement sensors such as a guyed type, a magnetic sensitive type and a photoelectric type. The excavator 101 may be an autonomous excavator or an intelligent excavator.

The excavator 101 may interact with the terminal device 103 or the server 104 through the network 102 to receive or transmit messages. The displacement sensor mounted on the excavator 101 may transmit collected electrical signals to the terminal device 103 or the server 104 in real time, for the terminal device 103 or the server 104 to calculate a rotating angle between mechanical arms of the excavator according to the electrical signals.

Various communication client applications, such as simulation calculation application, web browser application, shopping application, search application, instant messaging tool, mailbox client and social platform software, may be installed on the terminal device 103.

The terminal device 103 may be hardware or software. When the terminal device 103 is hardware, the terminal device may be various electronic devices including but not limited to a smart phone, a tablet computer, a laptop portable computer and a desktop computer. When the terminal device 103 is software, the terminal devices may be installed in the above-listed electronic devices. The terminal device may be implemented as a plurality of software programs or software modules (e.g., software programs or software modules for providing distributed services), or as a single software program or software module, which is not specifically limited here.

The server 104 may be a server that provides various services, for example, a backend server that calculates a position and an orientation of each component of the excavator 101. The backend server may process an electrical signal collected by the displacement sensor mounted on the excavator 101, and return a processing result (e.g., a rotating angle) to the excavator 101.

It should be noted that the server 104 may be hardware or software. When the server 104 is hardware, the server may be implemented as a distributed server cluster composed of a plurality of servers, or may be implemented as a single server. When the server 104 is software, the server may be implemented as a plurality of software programs or software modules (such as software programs or software modules for providing distributed services), or may be implemented as a single software program or software module, which is not specifically limited here.

It should be noted that the method for controlling equipment provided by some embodiments of the present disclosure may be executed by a control device in the excavator 101, or executed by the terminal device 103, or executed by the server 104. Accordingly, the device for controlling equipment may be provided in the control device in the excavator 101, or provided in the terminal device 103, or provided in the server 104. It may be appreciated that when the method according to the present embodiment is executed by the control device in the excavator 101, the system architecture 100 may not include the network 102, the terminal device 103 and the server 104.

It should be understood that the numbers of the excavators, terminal devices, networks and servers are merely illustrative. Any number of excavators, networks, terminal devices and servers may be provided according to actual requirements.

Figure 2:
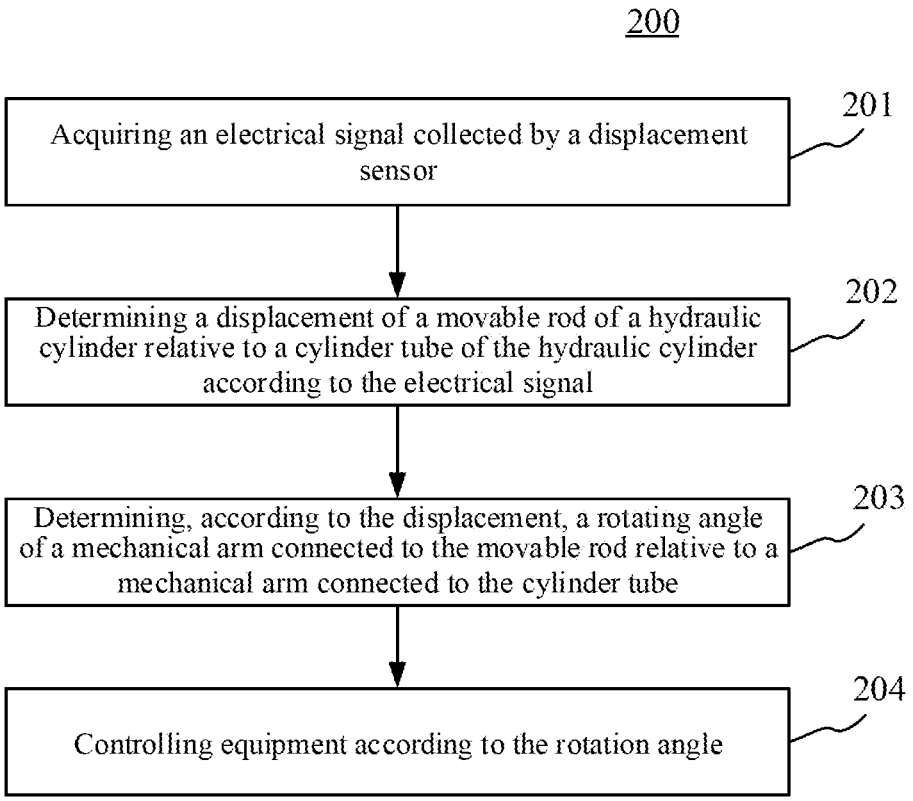
FIG. 2 is a flowchart of a method for controlling equipment according to an embodiment of the present disclosure.

Further, referring to FIG. 2, a flow 200 of a method for controlling equipment according to an embodiment of the present disclosure is shown. The method for controlling equipment according to the present embodiment comprises the following steps.

Step 201: acquiring an electrical signal collected by a displacement sensor.

In the present embodiment, an executing body of the method for controlling equipment may acquire the electrical signal collected by the displacement sensor through a wired or a wireless connection. The displacement sensor is used to measure a displacement of a movable rod of a hydraulic cylinder relative to a cylinder tube of the hydraulic cylinder. The electrical signal may be a voltage signal, a current signal or a resistance signal. It may be appreciated that the magnitude of the electrical signal is related to the displacement of the movable rod of the hydraulic cylinder relative to the cylinder tube of the hydraulic cylinder.

It should be noted that the wireless connection may include but not limited to: a 3G/4G connection, a WiFi connection, a Bluetooth connection, a WiMAX connection, a Zigbee connection, an UWB (ultra wideband) connection and other wireless connections that are currently known or are to be developed in future.

Step 202: determine a displacement of a movable rod of a hydraulic cylinder relative to a cylinder tube of the hydraulic cylinder according to the electrical signal.

Since a magnitude of the electrical signal is related to the displacement of the movable rod of the hydraulic cylinder relative to the cylinder tube of the hydraulic cylinder, such displacement may be calculated according to the magnitude of the electrical signal and a working principle of the displacement sensor.

Step 203: determine a rotating angle of a mechanical arm connected to the movable rod relative to a mechanical arm connected to the cylinder tube according to the displacement.

After the displacement of the movable rod of the hydraulic cylinder relative to the cylinder tube of the hydraulic cylinder is determined, the executing body may calculate a rotating angle between two mechanical arms in conjunction with mechanical structures of mechanical arms to which the hydraulic cylinder is connected. Specifically, the executing body may first determine an original length of the hydraulic cylinder, the displacement, a length from a connection point of the cylinder tube and a mechanical arm to a rotation center of the mechanical arm, and a length from a connection point of the movable rod and the mechanical arm to the rotation center of the mechanical arm; and then determine the rotating angle of the mechanical arm connected to the movable rod relative to the mechanical arm connected to the cylinder tube according to a triangle formed by the respective lengths.

Step 204: controlling equipment according to the rotating angle.

In the present embodiment, the executing body may know a position and an orientation of equipment in real time according to the acquired rotating angle, thereby controlling the equipment.

In some optional implementations of the present embodiment, the displacement sensor is a guyed displacement sensor.

In the prior art, a rotary angle sensor is generally added to a joint rotating shaft of the mechanical arm so as to measure the rotating angle of the mechanical arm. That is, the existing solution requires processing the joint rotating shaft, such as drilling, which may exert a large impact on the performance of the equipment itself, especially may reduce the strength of the joint rotating shaft, thus affecting the stability and durability of the equipment.

The guyed displacement sensor is particularly suitable for a hydraulic cylinder system, and the rotating angle of the mechanical arm may be calculated by measuring the displacement of the movable rod of the hydraulic cylinder relative to the cylinder tube of the hydraulic cylinder.

In some optional implementations of the present embodiment, the guyed displacement sensor includes a body and a pull wire, and one end of the pull wire is connected to the body. The body is fixed to the cylinder tube of the hydraulic cylinder, and the other end of the pull wire is fixed to the movable rod of the hydraulic cylinder.

In the present implementation, the body of the guyed displacement sensor is fixed to the cylinder tube of the hydraulic cylinder through various non-destructive methods, and the end, not connected to the body, of the pull wire is fixed to the movable rod of the hydraulic cylinder through various non-destructive methods, thereby measuring the movable displacement of the movable rod of the hydraulic cylinder. The non-destructive methods include, but not limited to, a fixed connection through a connector and a paste connection. Further, in order to reduce the calculation intensity, a movable end of the pull wire may be connected at a joint between the movable rod and the mechanical arm. In this way, the movement displacement of the movable rod may be equivalent to an extension length of the pull wire, so that the movement displacement of the movable rod may be obtained in real time. In the present implementation, the installation of the guyed displacement sensor has no damage to the equipment, and is simple.

In some optional implementations of the present embodiment, the equipment is an excavator comprising a plurality of hydraulic cylinders and a plurality of displacement sensors in one-to-one correspondence to the plurality of hydraulic cylinders. The excavator also comprises a bucket connected to an excavator chassis through a plurality of mechanical arms connected to the plurality of hydraulic cylinders. The executing body may acquire a rotating angle between two mechanical arms driven by each hydraulic cylinder by executing steps 201-203. Step 204 may be realized by executing the following steps not shown in FIG. 2: determining a position and an orientation of the bucket according to a plurality of rotating angles corresponding to the plurality of hydraulic cylinders; and controlling the equipment according to the position and the orientation of the bucket.

In the present implementation, the executing body may calculate a rotating angle corresponding to each hydraulic cylinder, and then calculate the position and the orientation of the bucket in combination with the structure of the excavator. Therefore, the excavator may be controlled to excavate a material according to the position and the orientation of the bucket.

In some optional implementations of the present embodiment, the electrical signal sent by the displacement sensor comprises an identifier. The executing body may determine, according to the identifier in the received electrical signal, an angle calculation formula corresponding to the identifier after receiving the electrical signal, and then determine the rotating angle according to the angle calculation formula and the displacement corresponding to the electrical signal. It may be understood that mechanical arms with different structures may have different angle calculation formulas.

Figure 3:
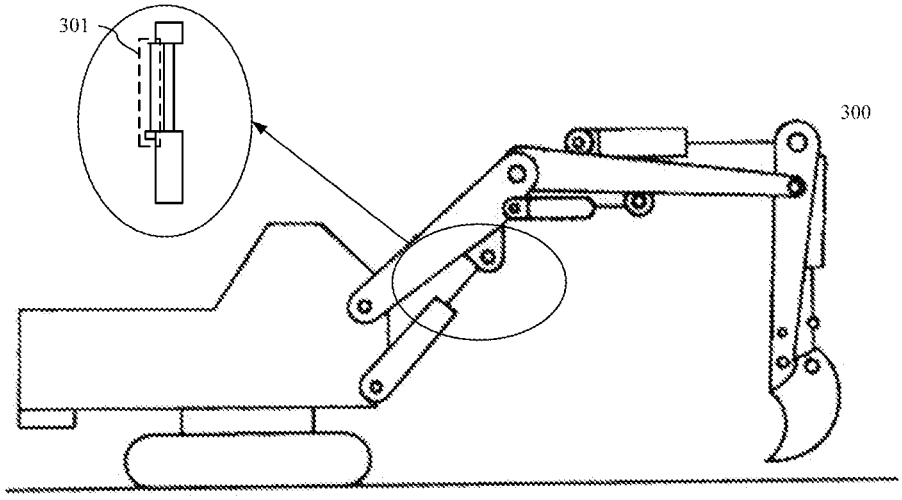
FIG. 3 is a schematic diagram of an application scenario of the method for controlling equipment according to an embodiment of the present disclosure.

Further referring to FIG. 3, a schematic diagram of an application scenario of the method for controlling equipment according to an embodiment is shown. In the application scenario in FIG. 3, a guyed displacement sensor 301 is mounted nearby a hydraulic cylinder of an excavator and is used for measuring a displacement of a movable rod of the hydraulic cylinder relative to a cylinder tube of the hydraulic cylinder. The guyed displacement sensor 301 sends a measured electrical signal to a control device of the excavator 300, and the control device calculates a rotating angle between mechanical arms according to the displacement, and then determines a position and an orientation of a bucket of the excavator 300, thereby controlling the excavator 300 to excavate a material.

The method for controlling equipment provided by some embodiments of the present disclosure may first acquire an electric signal collected by a displacement sensor, the displacement sensor being used for measuring a displacement of a movable rod of a hydraulic cylinder relative to a cylinder tube of the hydraulic cylinder; next, determine the displacement of the movable rod of the hydraulic cylinder relative to the cylinder tube of the hydraulic cylinder according to the electrical signal; then, determine a rotating angle of a mechanical arm connected to the movable rod relative to a mechanical arm connected to the cylinder tube according to the displacement; and finally, control equipment according to the rotating angle. The method according to some embodiments of the present disclosure may precisely sense a rotating angle between mechanical arms, and is thus conductive to automatically controlling the equipment.

Figure 4:
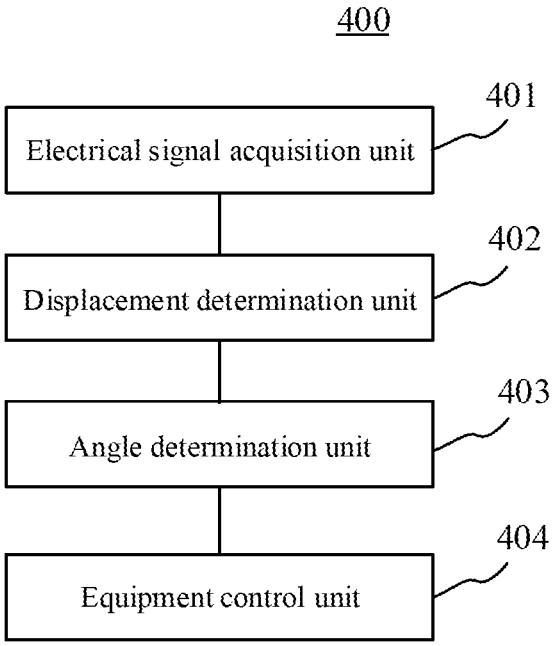
FIG. 4 is a schematic diagram of an apparatus for controlling equipment according to an embodiment of the present disclosure.

Further referring to FIG. 4, as an implementation of the method shown in the respective figures, an embodiment of the present disclosure provides an apparatus for controlling equipment. The apparatus embodiment may correspond to the method embodiment shown in FIG. 2, and the apparatus may be specifically applied to various electronic devices.

As shown in FIG. 4, the apparatus 400 for control equipment in the present embodiment comprises an electrical signal acquisition unit 401, a displacement determination unit 402, an angle determination unit 403 and an equipment control unit 404.

The electrical signal acquisition unit 101 is configured for acquiring an electrical signal collected by a displacement sensor, the displacement sensor being used for measuring a displacement of a movable rod of a hydraulic cylinder relative to a cylinder tube of the hydraulic cylinder.

The displacement determination unit 402 is configured for determining the displacement of the movable rod of the hydraulic cylinder relative to the cylinder tube of the hydraulic cylinder according to the electrical signal.

The angle determination unit 403 is configured for determining a rotating angle of a mechanical arm connected to the movable rod relative to a mechanical arm connected to the cylinder tube according to the displacement.

The equipment control unit 404 is configured for controlling equipment according to the rotating angle.

In some optional implementations of the present embodiment, the equipment is an excavator, and the equipment comprises a plurality of hydraulic cylinders and a plurality of displacement sensors in one-to-one correspondence to the plurality of hydraulic cylinders, and further comprises a bucket connected to a excavator chassis through a plurality of mechanical arms connected to the plurality of hydraulic cylinders.

The equipment control unit 404 is further configured for: determining a position and an orientation of the bucket according to a plurality of rotating angles corresponding to the plurality of hydraulic cylinders; and controlling the equipment according to the position and the orientation of the bucket.

In some optional implementations of the present embodiment, the electrical signal comprises an identifier; and the angle determination unit 403 is further configured for: determining, according to the identifier, an angle calculation formula corresponding to the identifier; and determining the rotating angle according to the displacement and the angle calculation formula.

In some optional implementations of the present embodiment, the displacement sensor is a guyed displacement sensor.

In some optional implementations of the present embodiment, the guyed displacement sensor comprises a body and a pull wire, and one end of the pull wire is connected to the body; and the body is fixed to the cylinder tube of the hydraulic cylinder, and the other end of the pull wire is fixed to the movable rod of the hydraulic cylinder.

It should be understood that the units 401-405 in the apparatus 400 for controlling equipment may correspond to the steps in the method shown in FIG. 2 respectively. Hence, the operation and features of the method for controlling equipment are also applicable to the apparatus 400 and units included therein, and will not be repeated here again.

Figure 5:
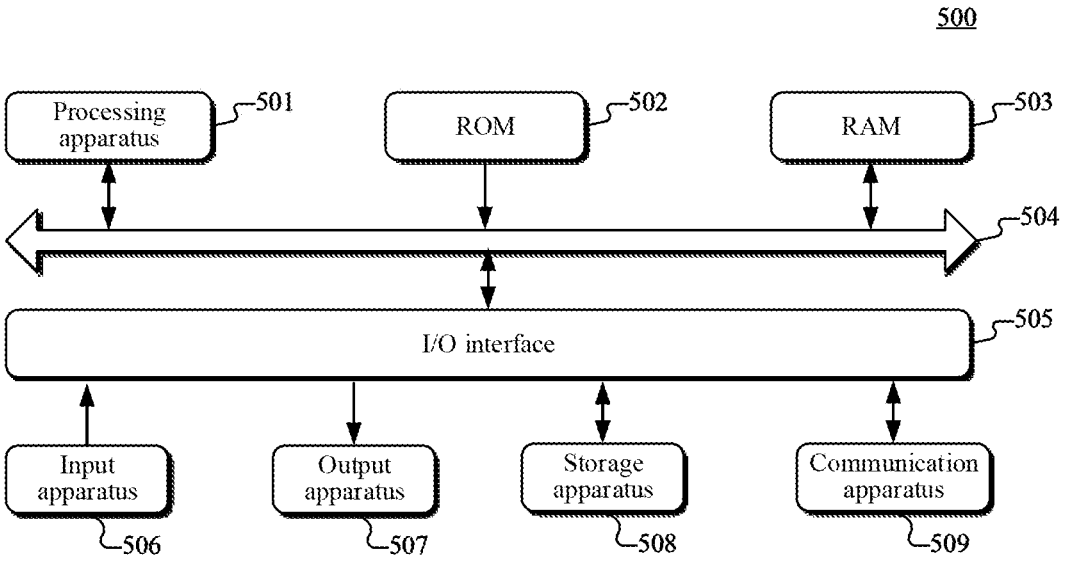
FIG. 5 is a schematic structural diagram of a computer system adapted to implement an electronic device of embodiments of the present disclosure.

Referring to FIG. 5, a schematic diagram of an electronic device (such as the server or the terminal device in FIG. 1) 500 adapted to implement some embodiments of the present disclosure is shown. The terminal device in some embodiments of the present disclosure may include, but not limited to, a mobile terminal such as a mobile phone, a notebook computer, a digital broadcast receiver, a PDA (Personal Digital Assistant), a PAD (Tablet), a PMP (Portable Multimedia Player) and an onboard terminal (for example, an onboard navigation terminal), and a fixed terminal such as a digital TV and a desktop computer. The terminal device/server shown in FIG. 5 is merely an example, and should not limit the function and scope of use of some embodiments of the present disclosure.

As shown in FIG. 5, the electronic device 500 may include a processing apparatus (such as a central processing unit, a graphic processor) 501, which may execute various appropriate actions and processes in accordance with a program stored in a read-only memory (ROM) 502 or a program loaded into a random access memory (RAM) 503 from a storage apparatus 508. The RAM 503 also stores various programs and data required by operations of the electronic device 500. The processing apparatus 501, the ROM 502 and the RAM 503 are connected to each other through a bus 504. An input/output (I/O) interface 505 is also connected to the bus 504.

Generally, the following devices may be connected to the I/O interface 505: an input apparatus 506 including, for example, a touch screen, a touch pad, a keyboard, a mouse, a camera, a microphone, an accelerometer and a gyroscope; an output apparatus 507 including, for example, a liquid crystal display (LCD), a speaker and a vibrator; a storage apparatus 508 including, for example, a magnetic tape, a hard disk; and a communication apparatus 509. The communication apparatus 509 may allow the electronic device 500 to exchange data with other apparatus by wireless or wireless communication. Although FIG. 5 illustrates an electronic device 500 having various apparatus, it should be understood that it is not required to implement or have all of the illustrated apparatuses. Alternatively, more or less apparatuses may be implemented. Each of the blocks shown in FIG. 5 may represent one apparatus or may represent multiple apparatuses as desired.

In particular, according to embodiments of the present disclosure, the process described above with reference to the flowchart may be implemented in a computer software program. For example, an embodiment of the present disclosure includes a computer program product, which comprises a computer program that is tangibly embedded in a machine-readable medium. The computer program includes program codes for executing the method as illustrated in the flowchart. In such an embodiment, the computer program may be downloaded and installed from a network via the communication apparatus 509, and/or may be installed from the storage apparatus 508, or may be installed from the ROM 502. The computer program, when executed by the processing apparatus 501, implements the functions as defined by the methods of embodiments of the present disclosure. It should be noted that the computer readable medium in an embodiment of present disclosure may be a computer readable signal medium or a computer readable storage medium or any combination of the above two. An example of the computer readable storage medium may include, but is not limited to: electric, magnetic, optical, electromagnetic, infrared, or semiconductor systems, apparatus, elements, or a combination of any of the above. A more specific example of the computer readable storage medium may include but is not limited to: an electrical connection with one or more wires, a portable computer disk, a hard disk, a random access memory (RAM), a read only memory (ROM), an erasable programmable read only memory (EPROM or flash memory), a fibre, a portable compact disk read only memory (CD-ROM), an optical memory, a magnet memory or any suitable combination of the above. In some embodiments of the present disclosure, the computer readable storage medium may be any tangible medium containing or storing programs which may be used by a command execution system, apparatus or element or incorporated thereto. In some embodiments of the present disclosure, the computer readable signal medium may include a data signal in a base band or propagating as parts of a carrier, in which computer readable program codes are carried. The propagating data signal may take various forms, including but not limited to: an electromagnetic signal, an optical signal or any suitable combination of the above. The computer readable signal medium may be any computer readable medium except for the computer readable storage medium. The computer readable signal medium is capable of transmitting, propagating or transferring programs for use by, or used in combination with, a command execution system, apparatus or element. The program codes contained on the computer readable medium may be transmitted with any suitable medium including but not limited to: wire, optical cable and RF (radio frequency) medium, or any suitable combination of the above.

The computer readable medium may be included in the electronic device, or a stand-alone computer readable medium not assembled into the electronic device. The computer readable medium stores one or more programs. The one or more programs, when executed by the electronic device, cause the electronic device to: acquire an electrical signal collected by a displacement sensor, the displacement sensor being used for measuring a displacement of a movable rod of a hydraulic cylinder relative to a cylinder tube of the hydraulic cylinder according to the electrical signal; determine the displacement of the movable rod of the hydraulic cylinder relative to the cylinder tube of the hydraulic cylinder according to the electrical signal; determine, according to the displacement, a rotating angle of a mechanical arm connected to the movable rod relative to a mechanical arm connected to the cylinder tube; and control equipment according to the rotating angle.

A computer program code for executing operations in some embodiments of the present disclosure may be compiled using one or more programming languages or combinations thereof. The programming languages include object-oriented programming languages, such as Java, Smalltalk or C++, and also include conventional procedural programming languages, such as "C" language or similar programming languages. The program code may be completely executed on a user's computer, partially executed on a user's computer, executed as a separate software package, partially executed on a user's computer and partially executed on a remote computer, or completely executed on a remote computer or server. In the circumstance involving a remote computer, the remote computer may be connected to the user's computer through any network, including local area network (LAN) or wide area network (WAN), or may be connected to an external computer (for example, connected through Internet using an Internet service provider).

The flowcharts and block diagrams in the accompanying drawings illustrate architectures, functions and operations that may be implemented according to the systems, methods and computer program products of the various embodiments of the present disclosure. In this regard, each of the blocks in the flowcharts or block diagrams may represent a module, a program segment, or a code portion, said module, program segment, or code portion comprising one or more executable instructions for implementing specified logic functions. It should also be noted that, in some alternative implementations, the functions denoted by the blocks may occur in a sequence different from the sequences shown in the figures. For example, any two blocks presented in succession may be executed, substantially in parallel, or they may sometimes be in a reverse sequence, depending on the function involved. It should also be noted that each block in the block diagrams and/or flow charts as well as a combination of blocks may be implemented using a dedicated hardware-based system executing specified functions or operations, or by a combination of a dedicated hardware and computer instructions.

The units involved in some embodiments of the present disclosure may be implemented through software or hardware. The described units may also be provided in a processor, for example, described as: a processor comprising an electrical signal acquisition unit, a displacement determination unit, an angle determination unit and an equipment control unit. In some case, names of these units do not constitute the definition of the units themselves. For example, the electrical acquisition unit may also be described as "a unit configured for acquiring an electrical signal collected by a displacement sensor."

The above description only provides an explanation of embodiments of the present disclosure and the technical principles used. It should be appreciated by those skilled in the art that the inventive scope of some embodiments of the present disclosure is not limited to the technical solutions formed by the particular combinations of the above-described technical features. The inventive scope should also cover other technical solutions formed by any combinations of the above-described technical features or equivalent features thereof without departing from the concept of the disclosure. Technical schemes formed by the features being interchanged with, but not limited to, technical features with similar functions disclosed in some embodiments of the present disclosure are examples.

What is claimed is:

1. A method for controlling equipment, comprising:

acquiring an electrical signal collected by a displacement sensor, wherein the displacement sensor is a guyed displacement sensor including a body and a pull wire;

determining a displacement of the movable rod of the hydraulic cylinder relative to the cylinder tube of the hydraulic cylinder according to the electrical signal, wherein an end of the pull wire is connected to the body fixed to a cylinder tube of a hydraulic cylinder, the other end of the pull wire is connected at a joint between the movable rod and the mechanical arm, and determining the displacement of the movable rod of the hydraulic cylinder relative to the cylinder tube of the hydraulic cylinder according to the electrical signal comprises determining an extension length of the pull wire as the movement displacement of the movable rod;

determining, according to the displacement, a rotating angle of a mechanical arm connected to the movable rod relative to a second mechanical arm connected to the cylinder tube; and controlling equipment according to the rotating angle.

2. The method according to claim 1, wherein the equipment is an excavator, and the equipment comprises a plurality of hydraulic cylinders and a plurality of displacement sensors in one-to-one correspondence to the plurality of hydraulic cylinders, and further comprises a bucket connected to an excavator chassis through a plurality of mechanical arms connected to the plurality of hydraulic cylinders; and the controlling equipment according to the rotating angle comprises:

determining a position and an orientation of the bucket according to a plurality of rotating angles corresponding to the plurality of hydraulic cylinders; and controlling the equipment according to the position and the orientation of the bucket.

3. The method according to claim 2, wherein the electrical signal comprises an identifier; and the determining the rotating angle of the mechanical arm connected to the movable rod relative to the mechanical arm connected to the cylinder tube according to the displacement comprises:

determining, according to the identifier, an angle calculation formula corresponding to the identifier; and determining the rotating angle according to the displacement and the angle calculation formula.

4. An apparatus for controlling equipment, comprising:

at least one processor; and a memory storing instructions, the instructions when executed by the at least one processor, cause the at least one processor to perform operations, the operations comprising:

acquiring an electrical signal collected by a displacement sensor, the displacement sensor being used for measuring a displacement of a movable rod of a hydraulic cylinder relative to a cylinder tube of the hydraulic cylinder, wherein the displacement sensor is a guyed displacement sensor including a body and a pull wire;

determining the displacement of the movable rod of the hydraulic cylinder relative to the cylinder tube of the hydraulic cylinder according to the electrical signal, wherein an end of the pull wire is connected to the body fixed to a cylinder tube of a hydraulic cylinder, the other end of the pull wire is connected at a joint between the movable rod and the mechanical arm, and determining the displacement of the movable rod of the hydraulic cylinder relative to the cylinder tube of the hydraulic cylinder according to the electrical signal comprises determining an extension length of the pull wire as the movement displacement of the movable rod;

determining, according to the displacement, a rotating angle of a mechanical arm connected to the movable rod relative to a mechanical arm connected to the cylinder tube; and controlling equipment according to the rotating angle.

5. The apparatus according to claim 4, wherein the equipment is an excavator, and the equipment comprises a plurality of hydraulic cylinders and a plurality of displacement sensors in one-to-one correspondence to the plurality of hydraulic cylinders, and further comprises a bucket connected to an excavator chassis through a plurality of mechanical arms connected to the plurality of hydraulic cylinders; and the controlling equipment according to the rotating angle comprises:

determining a position and an orientation of the bucket according to a plurality of rotating angles corresponding to the plurality of hydraulic cylinders; and controlling the equipment according to the position and the orientation of the bucket.

6. The apparatus according to claim 5, wherein the electrical signal comprises an identifier; and the determining the rotating angle of the mechanical arm connected to the movable rod relative to the mechanical arm connected to the cylinder tube according to the displacement comprises:

determining, according to the identifier, an angle calculation formula corresponding to the identifier; and determining the rotating angle according to the displacement and the angle calculation formula.

7. A non-transitory computer readable medium, storing a computer program, wherein the computer program, when executed by a processor, causes the processor to perform operations, the operations comprising:

acquiring an electrical signal collected by a displacement sensor, the displacement sensor being used for measuring a displacement of a movable rod of a hydraulic cylinder relative to a cylinder tube of the hydraulic cylinder, wherein the displacement sensor is a guyed displacement sensor including a body and a pull wire;

determining the displacement of the movable rod of the hydraulic cylinder relative to the cylinder tube of the hydraulic cylinder according to the electrical signal, wherein an end of the pull wire is connected to the body fixed to a cylinder tube of a hydraulic cylinder, the other end of the pull wire is connected at a joint between the movable rod and the mechanical arm, and determining the displacement of the movable rod of the hydraulic cylinder relative to the cylinder tube of the hydraulic cylinder according to the electrical signal comprises determining an extension length of the pull wire as the movement displacement of the movable rod;

determining, according to the displacement, a rotating angle of a mechanical arm connected to the movable rod relative to a second mechanical arm connected to the cylinder tube; and controlling equipment according to the rotating angle.

8. The method according to claim 1, wherein determining, according to the displacement, the rotating angle of the mechanical arm connected to the movable rod relative to the second mechanical arm connected to the cylinder tube comprises: determining an original length of the hydraulic cylinder, a length from a connection point of the cylinder tube and the mechanical arm to a rotation center of the mechanical arm, and a length from a connection point of the movable rod and the mechanical arm to the rotation center of the mechanical arm; and determining the rotating angle of the mechanical arm connected to the movable rod relative to the second mechanical arm connected to the cylinder tube based on the movement displacement of the movable rod and the lengths.

* * * * *